US006832936B2

(12) United States Patent
Peloza et al.

(10) Patent No.: US 6,832,936 B2
(45) Date of Patent: Dec. 21, 2004

(54) TERMINAL MODULE FOR ELECTRICAL CONNECTOR

(75) Inventors: Kirk B. Peloza, Naperville, IL (US); Kent Regnier, Lombard, IL (US); Yew Teck Yap, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/272,861

(22) Filed: Oct. 17, 2002

(65) Prior Publication Data

US 2004/0077221 A1 Apr. 22, 2004

(51) Int. Cl.[7] ..... H01R 13/405
(52) U.S. Cl. ..... 439/736; 439/630
(58) Field of Search ..... 439/630, 637, 439/733.1, 736, 874, 875

(56) References Cited

U.S. PATENT DOCUMENTS

| | | | | | |
|---|---|---|---|---|---|
| 3,333,231 | A | * | 7/1967 | Travis | 439/631 |
| 4,602,831 | A | | 7/1986 | Lockard | |
| 4,769,908 | A | * | 9/1988 | Olsson | 29/884 |
| 4,817,283 | A | | 4/1989 | Johnston et al. | 29/884 |
| 5,380,225 | A | | 1/1995 | Inaoka | 439/660 |
| 5,572,779 | A | | 11/1996 | Adelman et al. | 29/25.42 |
| 5,702,258 | A | | 12/1997 | Provencher et al. | 439/79 |
| 5,795,194 | A | | 8/1998 | Hahn | 439/660 |
| 5,975,920 | A | | 11/1999 | Oberstarr | 439/83 |
| 6,007,387 | A | | 12/1999 | Uchiyama | 439/736 |
| 6,059,601 | A | | 5/2000 | Hirai et al. | 439/405 |
| 6,155,886 | A | | 12/2000 | Kosecki et al. | 439/736 |
| 6,217,393 | B1 | | 4/2001 | Muta | 439/736 |
| 6,354,886 | B1 | | 3/2002 | Yu | 439/701 |
| 6,363,607 | B1 | * | 4/2002 | Chen et al. | 29/883 |
| 6,368,158 | B1 | * | 4/2002 | Kan | 439/676 |
| 6,558,202 | B1 | | 5/2003 | Hahn | 439/660 |

OTHER PUBLICATIONS

U.S. Appl. No. US 2002/0106930 dated Aug. 8, 2002.
International Search Report.

* cited by examiner

*Primary Examiner*—Lynn Feild
*Assistant Examiner*—Thanh-Tam Le
(74) *Attorney, Agent, or Firm*—Stephen Z. Weiss

(57) ABSTRACT

A terminal module is provided for use in an electrical connector. The module includes a plurality of conductive terminals arranged in a generally parallel side-by-side array. Each terminal includes a pair of opposite end sections. A pair of holding sections are located respectively adjacent to and inside the end sections. A central section is located between the holding sections. A dielectric plastic housing is overmolded about the holding sections leaving the opposite end sections exposed. The overmolded housing leaves a substantial portion of the central section exposed.

11 Claims, 6 Drawing Sheets

TERMINAL MODULE FOR ELECTRICAL CONNECTOR

FIELD OF THE INVENTION

This invention generally relates to the art of electrical connectors and, particularly, to a terminal module for an electrical connector.

BACKGROUND OF THE INVENTION

A typical electrical connector includes some form of dielectric housing which mounts a plurality of conductive terminals. Various methods are used to mount the terminals in or on the housing. One method is to insert the terminals into preformed terminal-receiving passages in the housing either one terminal at a time or all of the terminals on a strip in a "gang" insertion. Another method is to mold a dielectric plastic insert around portions of a plurality of terminals to form a terminal module or subassembly. This module then is mounted in a cavity in the dielectric connector housing.

A significant problem with overmolded terminal modules as described above is that the plastic material is overmolded about substantial portions of the terminals and effectively decreases the impedance through the terminal module. This decrease in impedance can reduce the signal strength due to signal reflection. Little has been done with prior art overmolded terminal modules to prevent this decrease in impedance. The present invention is directed to a simple solution to this impedance problem in an overmolded terminal module.

SUMMARY OF THE INVENTION

An object, therefore, of the invention is to provide a new and improved terminal module for use in an electrical connector.

In the exemplary embodiment of the invention, the terminal module includes a plurality of terminals arranged in a generally parallel side-by-side array. Each terminal includes a pair of opposite end sections such as contact and/or termination sections. A pair of holding sections are located respectively adjacent to and inside the end sections. A central section is located between the holding sections. A dielectric plastic housing is overmolded about the holding sections of the terminals leaving the opposite end sections of the terminals exposed. The overmolded housing leaves a substantial portion of the central section of each terminal exposed to reduce the loss of impedance through the terminal module.

According to one aspect of the invention, the central section of each terminal is generally rectangular in cross-section to define a top surface, a bottom surface and a pair of side surfaces. The overmolded housing leaves at least the top surface exposed. As disclosed herein, the overmolded housing leaves the top surface and side surfaces exposed while supporting the bottom surface of the terminal central section.

According to another aspect of the invention, the central section of each terminal can be considered as having a given thickness, with the top of the terminal being exposed by the overmolded housing and the bottom of the terminal being supported by the overmolded housing. A trough is formed in the overmolded housing between the central sections of adjacent terminals. The trough has a depth extending beyond the thickness of the central section, i.e., below the bottom of the terminal.

According to a further aspect of the invention, the terminals are elongated, and the length of the central section of each terminal is greater than 30 per cent of to the combined lengths of the terminal sections within the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
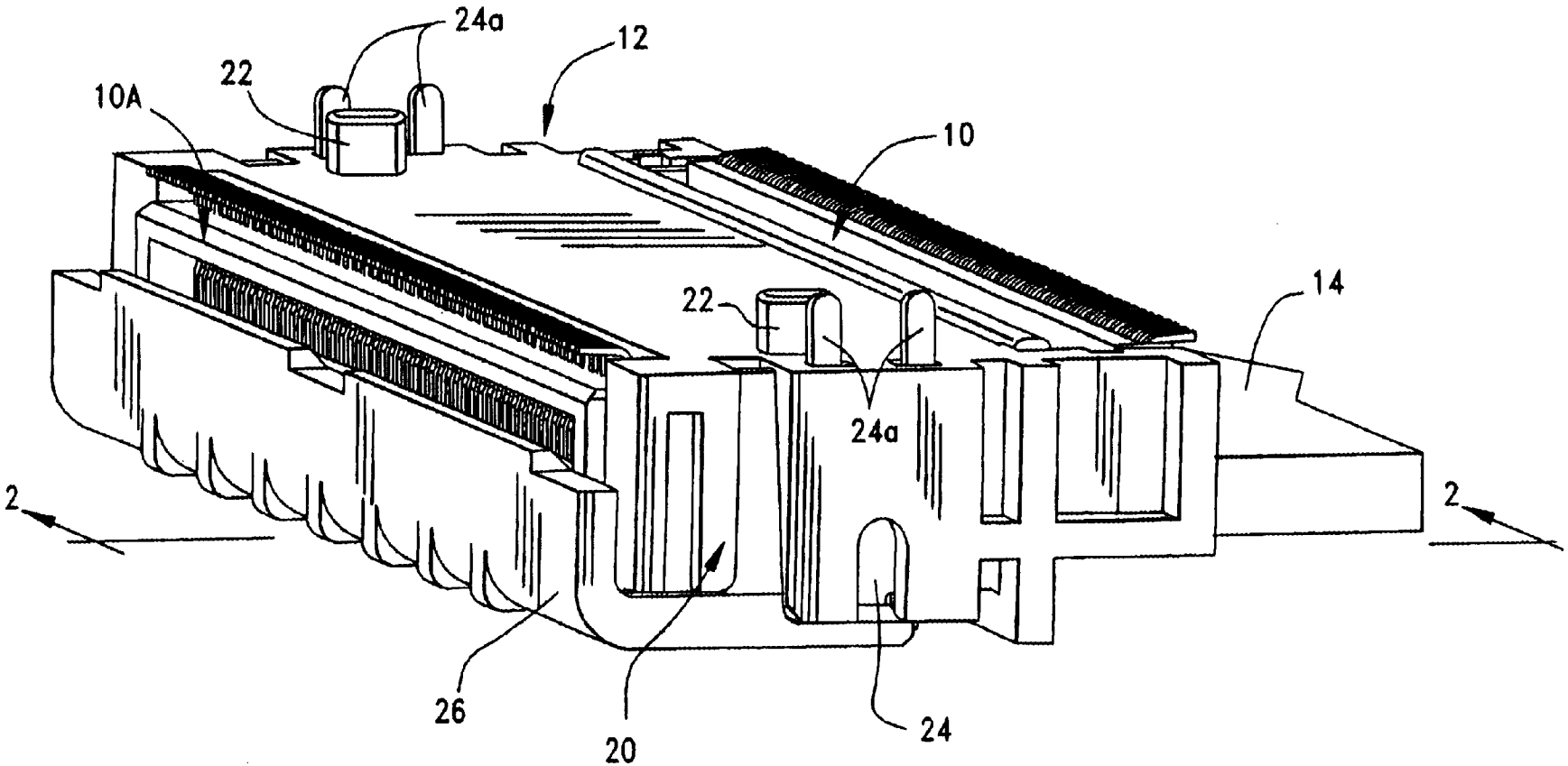
FIG. 1 is a perspective view looking at the bottom of an electrical connector assembly incorporating a pair of terminal modules according to the invention.
Figure 2:
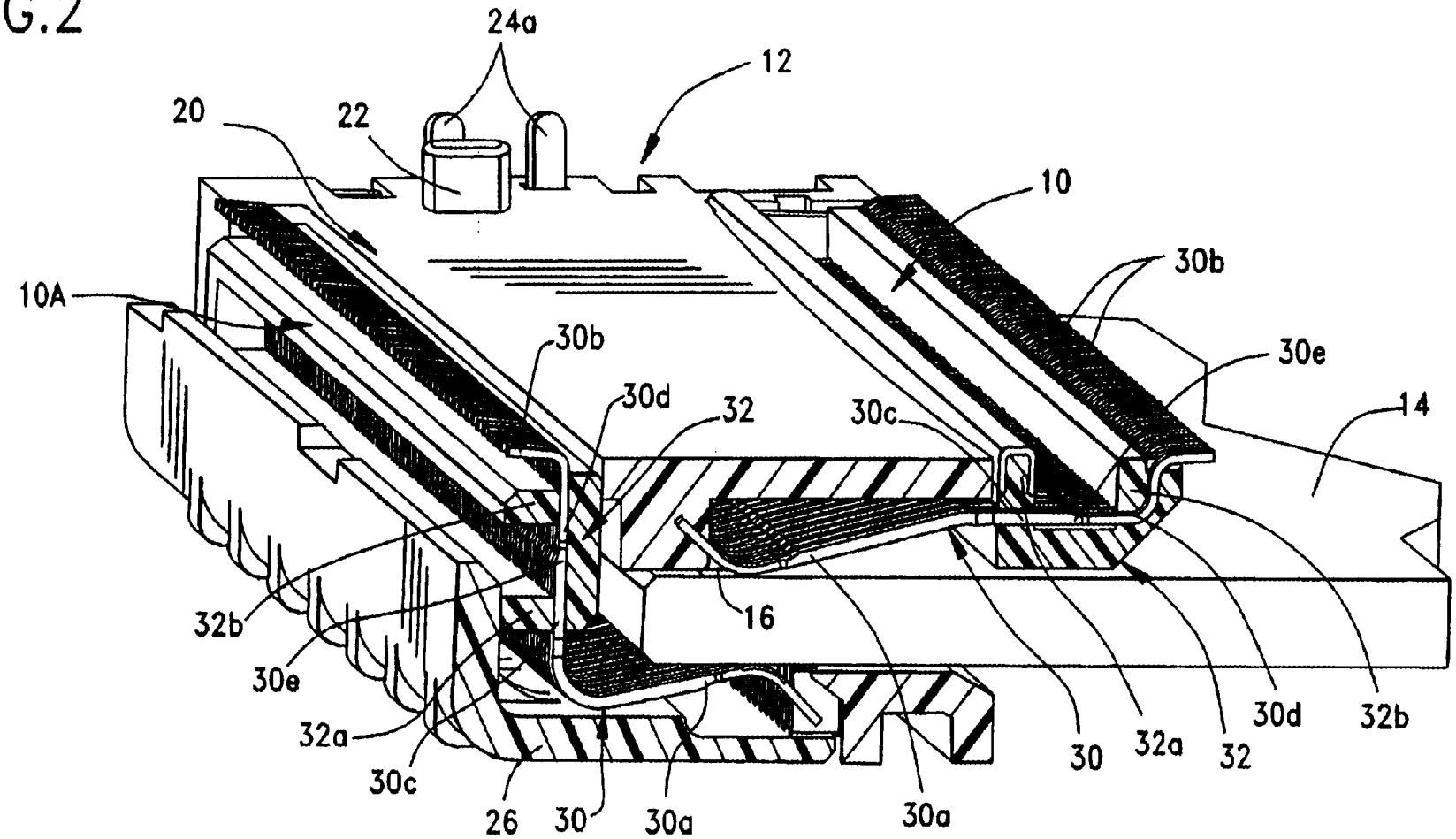
FIG. 2 is a vertical section taken generally along line 2—2 of FIG. 1.
Figure 3:
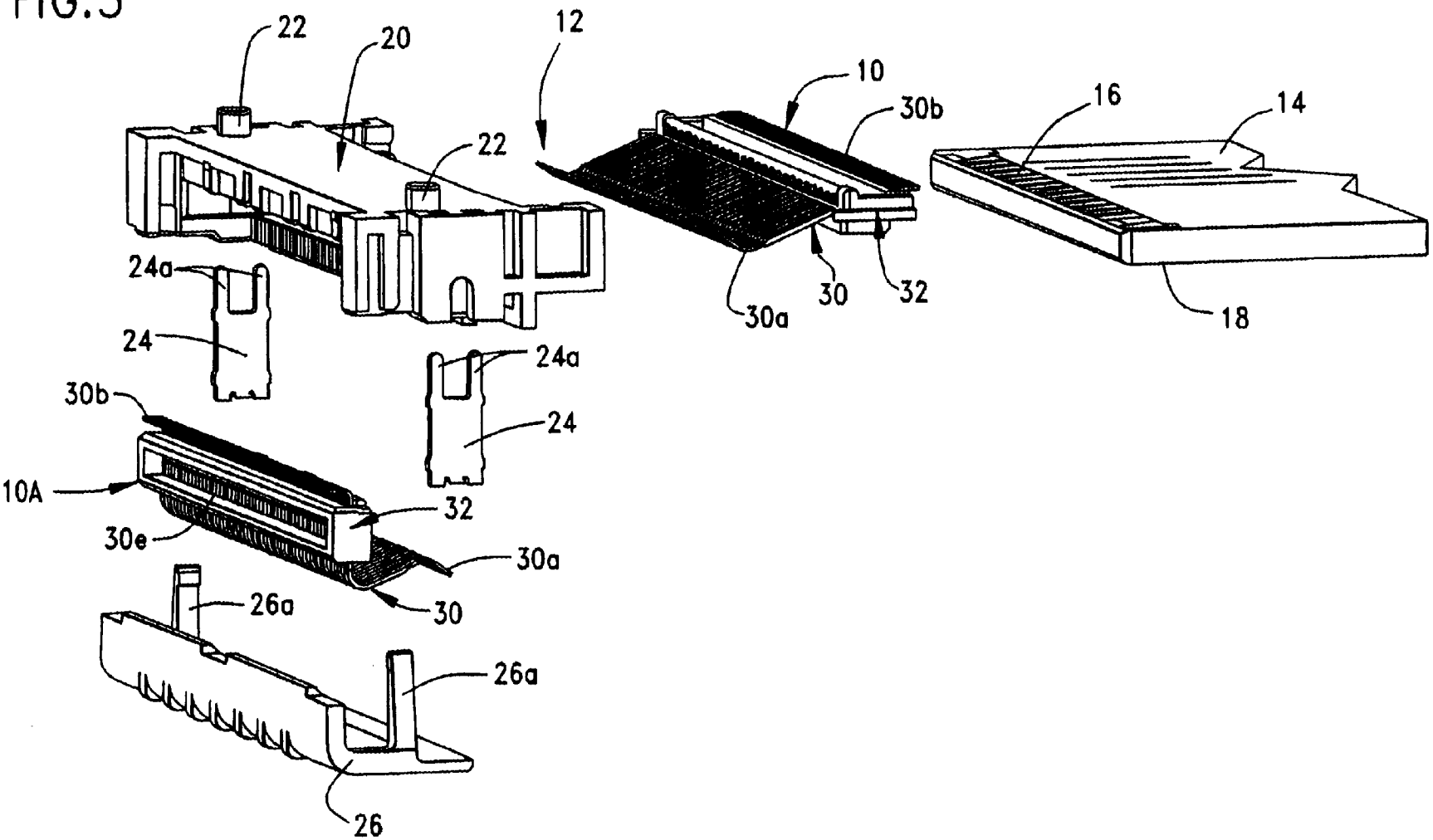
FIG. 3 is an exploded perspective view of the connector assembly of FIG. 1.

Referring to the drawings in greater detail, and first to FIGS. 1–3, the invention is embodied in a pair of terminal modules, generally designated 10 and 10A, which are used in an electrical connector assembly, generally designated 12. The connector assembly is designed for receiving a circuit board 14 having contacts 16 on one side thereof and contacts 18 on an opposite side thereof. As will be seen hereinafter, contacts 16 and 18 on opposite sides of the circuit board engage terminals of terminal modules 10 and 10A.

At this point, it should be understood that the inventive concepts embodied in terminal modules 10 and 10A can be used in a wide variety of connector assemblies or configurations. Connector assembly 12 is but one assembly with which the terminal modules can be used.

In addition, it should be understood that the use of such terms as "top", "bottom" and the like herein and in the claims hereof is for providing a more clear and concise description of the invention. The terminal modules and the connector assembly, itself, can be used in omni-directional applications. In fact, connector assembly 12 is shown in FIGS. 1–3 in what could be considered an upside-down orientation. In other words, the connector assembly is adapted for mounting on a second circuit board (not shown) which is positioned onto the top of the assembly as shown in FIGS. 1–3, whereas in actual practice the connector assembly most likely would be positioned down onto the circuit board.

With those understandings, terminal modules 10 and 10A are mounted on a connector housing, generally designated 20, which includes a pair of mounting posts 22 for insertion into appropriate mounting holes in the second circuit board. A pair of hold-down members 24 are mounted in cavities within housing 20 and include mounting legs 24*a* for insertion into appropriate mounting holes in the second circuit board. Connector housing 20 may be molded of dielectric plastic material, and hold-down members 24 may be fabricated of metal material. A cover 26 is mounted onto connector housing 20 by means of a pair of latch arms 26*a*. As stated above, the invention incorporated in terminal modules 10 and 10A can be used in a wide variety of connector assemblies, and such components as hold-down members 24 and cover 26 may not even be employed.

Figure 4:
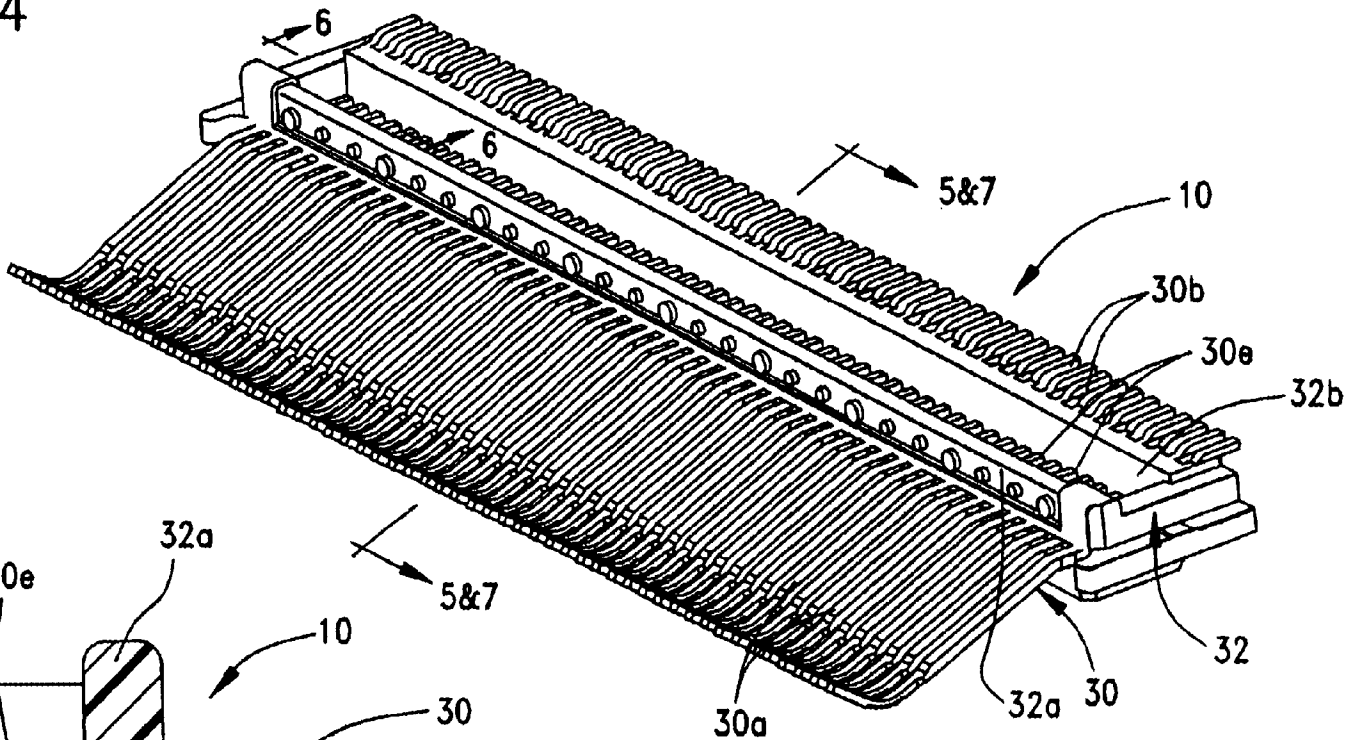
FIG. 4 is a bottom perspective view of one of the terminal modules according to the invention.
Figure 5:
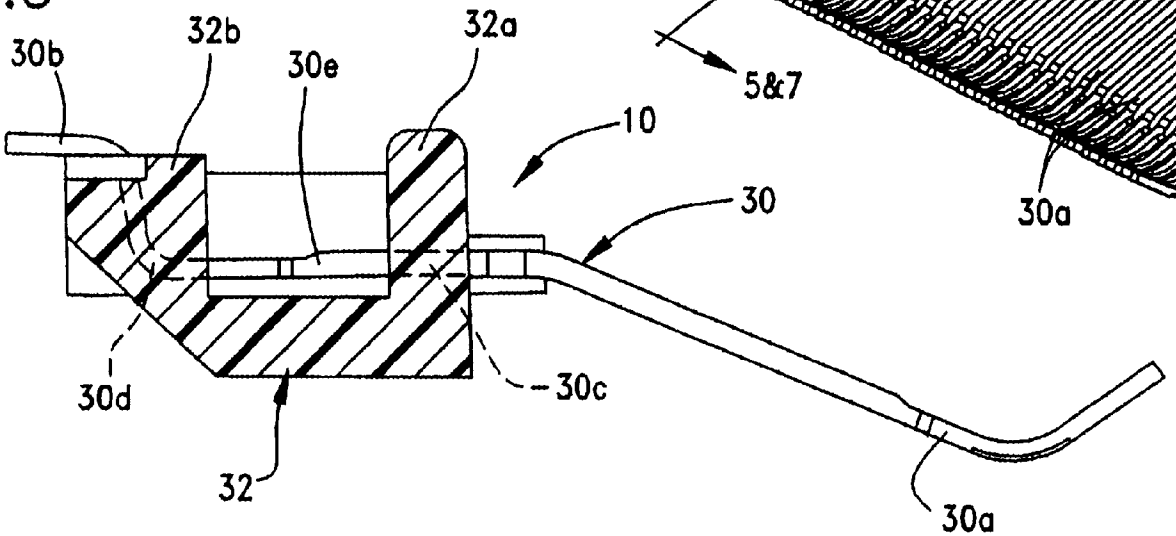
FIG. 5 is a somewhat enlarged vertical section taken generally along line 5—5 of FIG. 4.

FIGS. 4 and 5 show terminal module 10 in greater detail, particularly in conjunction with FIG. 2. The terminal module includes a plurality of elongated conductive terminals, generally designated 30, which are arranged in a generally parallel side-by-side array as is clearly shown in FIG. 4. The terminals may be stamped and formed of conductive sheet metal material. Each elongated terminal 30 includes a pair of opposite end sections 30*a* and 30*b* which form contacts or tail portions of the terminal at opposite ends thereof. End sections or tail portions 30*a* of the terminals are provided for engaging contacts 16 (FIG. 3) of circuit board 14 as seen in FIG. 2. End sections or tail portions 30*b* of the terminals are provided for engaging contacts on the second circuit board (not shown) to which connector assembly 12 is mounted. Each terminal 30 also includes a pair of holding sections 30*c* and 30*d* located immediately adjacent to and inside end sections 30*a* and 30*b*, respectively. A central section 30*e* is located between holding sections 30*c* and 30*d*.

Figure 8:
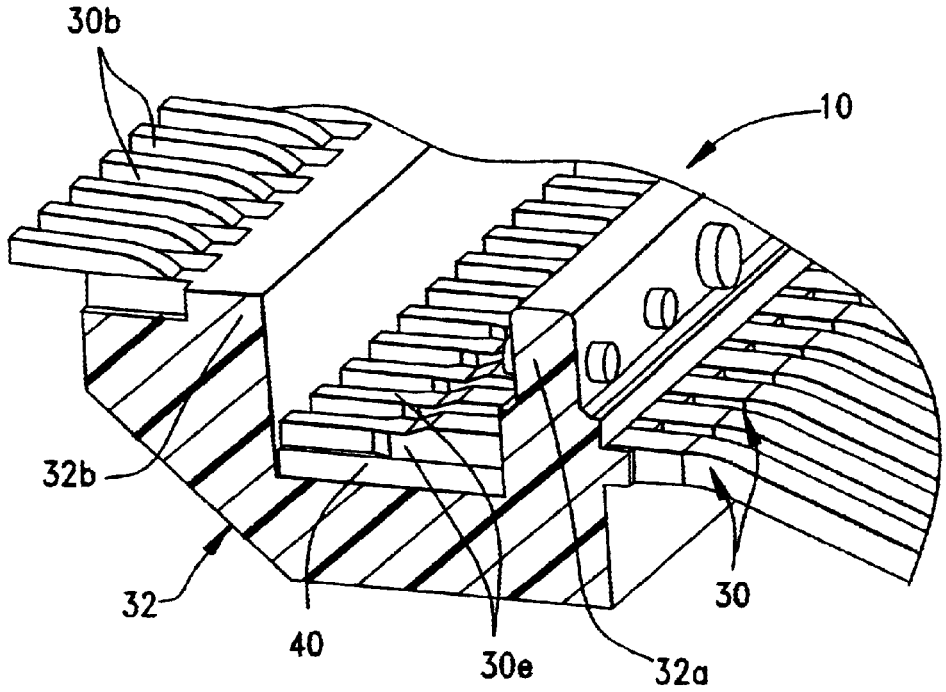
FIG. 8 is a fragmented, enlarged, perspective view looking at the sectioned end of the overmolded housing in FIG. 7.
Figure 9:
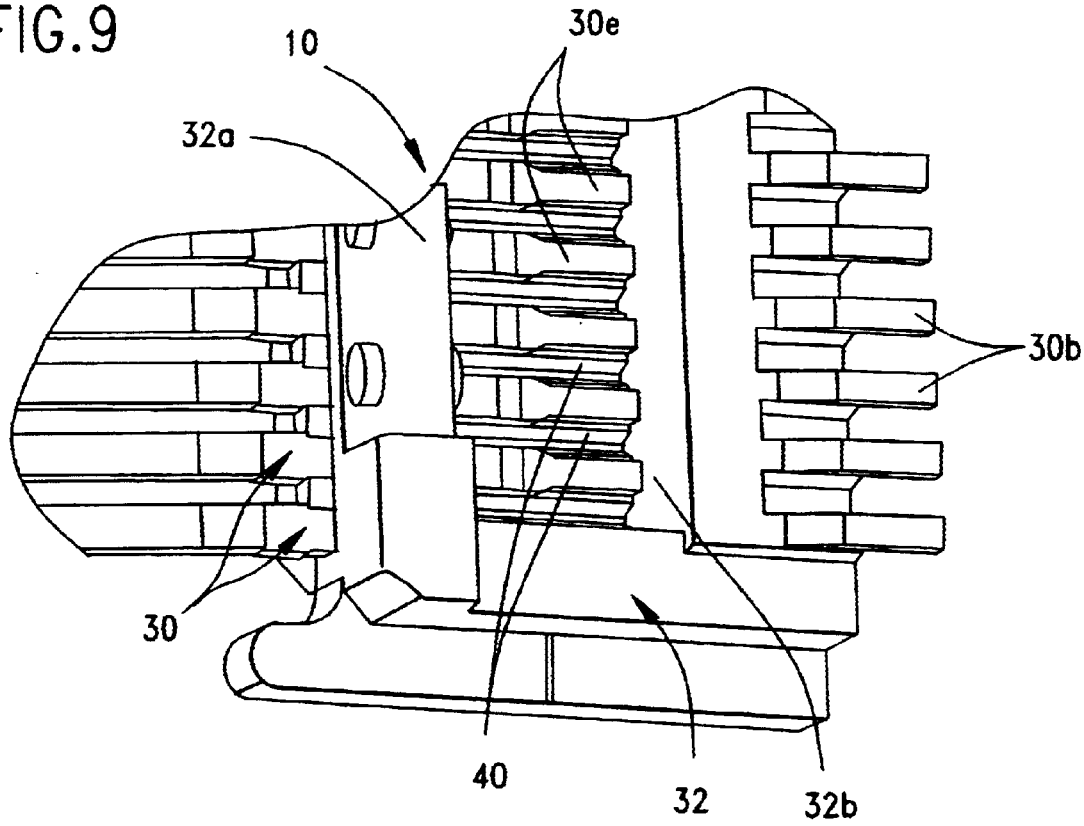
FIG. 9 is a further enlarged, fragmented perspective view looking down on the overmolded portions of the terminals as viewed in FIGS. 7 and 8.

Still referring to FIGS. 4 and 5 particularly in conjunction with FIG. 2, terminal module 10 includes a dielectric plastic housing, generally designated 32, which is overmolded about holding sections 30*c* and 30*d* of terminals 30, leaving opposite end sections or tail portions 30*a* and 30*b* exposed as is seen clearly in FIG. 5. In essence, overmolded housing 32 includes a pair of ribs 32*a* and 32*b* which are overmolded about holding sections 30*c* and 30*d*, respectively, of the terminals as shown in FIGS. 5, 8 and 9, portions of terminal section 30*e* and all of terminal section 30*b* have a reduced cross section shown in the drawings as 30*f*. This reduced cross section will further allow the control of impedance and will create a more easily solderable tail portion 30*b*.

Figure 6:
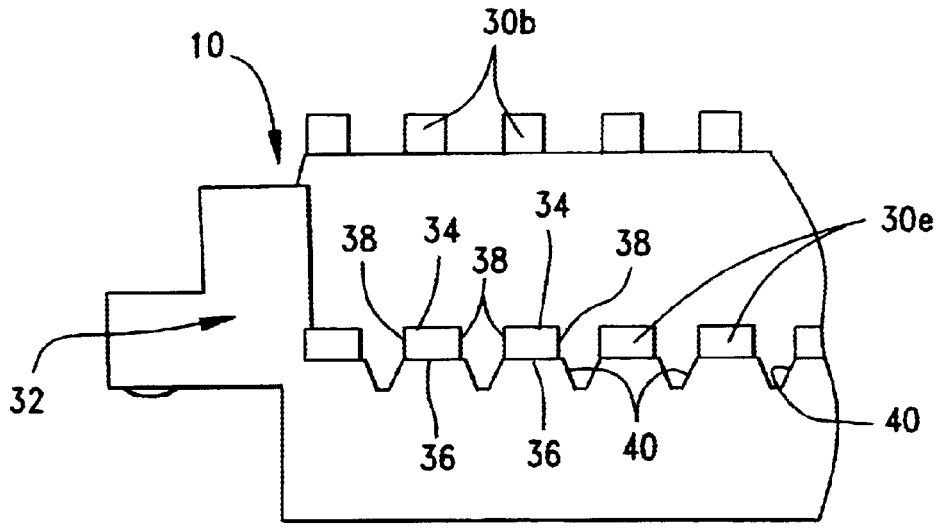
FIG. 6 is a fragmented, enlarged vertical section taken generally along line 6—6 of FIG. 4.

Referring to FIG.6 in conjunction with FIG. 5, overmolded housing 32 of terminal module 10 leaves a substantial portion of central section 30*e* of each terminal exposed. In the exemplary embodiment, central section 30*e* of each stamped and formed terminal is generally rectangular in cross-section to define a top surface 34, a bottom surface 36 and a pair of opposite side surfaces 38. It can be seen clearly in FIG. 6 that the plastic material of overmolded housing 32 leaves top surfaces 34 and side surfaces 38 of the central sections of the terminals completely exposed, while the plastic material of the overmolded housing supports bottom surfaces 36 of the terminals. Therefore, while holding sections 30*c* and 30*d* of the terminals rigidly secure the terminals within overmolded housing 32, central sections 30*e* of the terminals remain substantially exposed which effectively reduces the loss of impedance through the terminal module which otherwise would occur if the terminals were entirely surrounded by the overmolded plastic material between opposite end sections or tail portions 30*a* and 30*b*.

Figure 7:
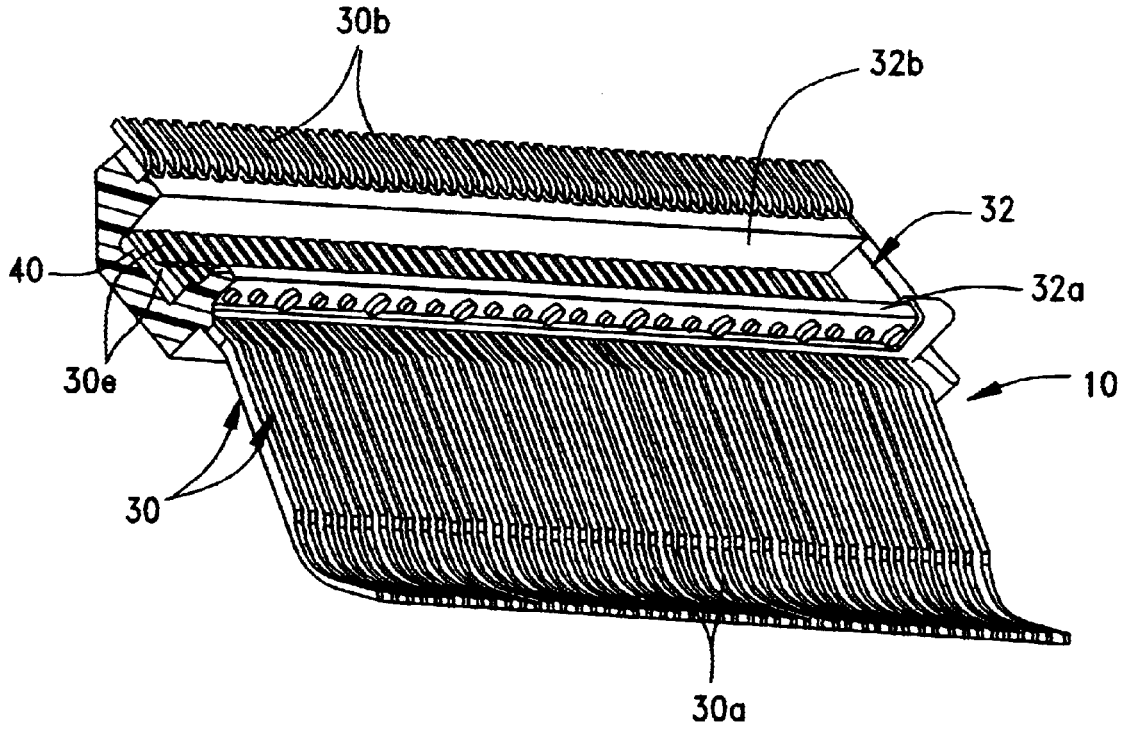
FIG. 7 is a perspective section taken generally along line 7—7 of FIG. 4.

According to another aspect of the invention for controlling the impedance through terminal module 10, reference is made to FIGS. 7 and 8 particularly in conjunction with FIG. 6. It can be seen that overmolded housing 32 is molded with a trough 40 between central sections 30*e* of adjacent terminals. In other words, each central section 30*e* can be considered as having a given thickness between top and bottom surfaces 34 and 36, respectively, and troughs 40 extend downwardly into the plastic material of the overmolded housing below the thickness or bottom surfaces of the terminals. This further reduces the signal reflection of the terminals on the plastic material of the housing in order to further control the impedance through the terminal module. FIG. 9 is a depiction looking downwardly into troughs 40 between the central sections of the terminals.

Finally, as best seen in FIG. 5, the invention contemplates that the length of central section 30*e* of each terminal 30 is greater than 30 per cent of the combined lengths of sections 30*c*, 30*d*, and 30*e* which are within the housing. Holding sections 30*c* and 30*d* are embedded within ribs 30*a* and 30*b*, respectively, in the longitudinal direction of the terminal; i.e., in a generally straight-line distance between opposite end sections 30*a* and 30*b* of the terminal.

Terminal module 10A is substantially identical to terminal module 10, except for the shape of end sections or tail portions 30*a* of the terminals. Tail portions 30*a* of the terminals of terminal module 10A are configured for engaging contacts 18 (FIG. 3) of circuit board 14.

It will be understood that the invention maybe embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A terminal module for use in an electrical connector, comprising:

a plurality of conductive terminals arranged in a generally parallel side-by-side array, each terminal including a pair of opposite end sections, a pair of holding sections located respectively adjacent to and inside the end sections, and a central section between the holding sections; and a dielectric plastic housing overmolded about the holding sections of the terminals leaving the opposite end sections of the terminals exposed, the overmolded housing leaving a substantial portion of said central section of each terminal exposed, the central section of each terminal having a top surface, a bottom surface and a pair of side surfaces, and the overmolded housing leaving the top surface and the side surfaces of the central section exposed and supporting the bottom surface with the dielectric plastic housing in direct contact with the bottom surface of the central section.

2. The terminal module of claim 1 wherein the central section of each terminal has a given thickness and further including a trough in the overmolded housing between the central section of adjacent terminals, the trough having a depth extending beyond the thickness of the central section into the overmolded housing.

3. The terminal module of claim 1 wherein said terminals are elongated and the central section of the terminals having a given length extending between the holding sections and the holding sections of the terminal having a total embedded length within the overmolded housing and further wherein the given length of the central section of each terminal is greater than 30 per cent of the combined lengths of the total embedded length of the holding terminal sections and the given length of the central terminal section.

4. The terminal module of claim 3 wherein a portion of the central section and one end section have a cross section which is less than a cross section of the remaining portion of the central section and the other end section of the terminal.

5. A terminal module for use in an electrical connector, comprising:

a plurality of conductive terminals arranged in a generally parallel side-by-side array, each terminal including a pair of opposite end sections, a pair of holding sections located respectively adjacent to and inside the end sections, and a central section between the holding sections, the central section being generally rectangular in cross-section to define a top surface, a bottom surface and a pair of side surfaces; and a dielectric plastic housing overmolded about the holding sections of the terminals leaving the opposite end sections of the terminals exposed, the overmolded housing leaving the top surface and side surfaces of the central section of each terminal exposed, with the overmolded housing supporting the bottom surface of the central section with the dielectric plastic housing in direct contact with the bottom surface of the central section.

6. The terminal module of claim 5 wherein said central section of each terminal has a given thickness, with the top of the terminal being exposed by the overmolded housing and the bottom of the terminal being supported by the overmolded housing.

7. The terminal module of claim 6, wherein the central section of each terminal has a given thickness and further including a trough in the overmolded housing between the central section of adjacent terminals, the trough having a depth extending beyond the thickness of the central section into the overmolded housing.

8. The terminal module of claim 5 wherein said terminals are elongated, and the central section of each terminal having a given length and the holding section of each terminal having a total embedded length within the overmolded housing and further wherein the given length of the central section of each terminal is at least equal to the total embedded length of the holding sections of the terminal.

9. The terminal module of claim 8 wherein the given length of the central section of each terminal is greater than 30 percent of the combined lengths of the total embedded length of the holding sections and the given length of the central terminal section.

10. The terminal module of claim 5 wherein said terminals are stamped and formed of sheet metal material.

11. The terminal module of claim 5 wherein a portion of the central section and one end section have a cross section which is less than a cross section of the remaining portion of the central section and the other end section of the terminal.

* * * * *